US010169966B1

(12) United States Patent
Zeng et al.

(10) Patent No.: US 10,169,966 B1
(45) Date of Patent: Jan. 1, 2019

(54) NETWORKING COMMUNICATION METHOD FOR MULTI-SLAVE CABLE ANTI-THEFT MONITORING SYSTEM

(71) Applicant: Chongqing Yufeng Xinxin Wire & Cable Technology Co., Ltd., Chongqing (CN)

(72) Inventors: Lingguo Zeng, Chongqing (CN); Zhijun Li, Chongqing (CN); Zhouquan Yang, Chongqing (CN)

(73) Assignee: Chongqing Yufeng Xinxin Wire & Cable Technology Co., Ltd., Chongqing (CN)

( * ) Notice: Subject to any disclaimer, the term of this patent is extended or adjusted under 35 U.S.C. 154(b) by 0 days.

(21) Appl. No.: 15/800,421

(22) Filed: Nov. 1, 2017

(30) Foreign Application Priority Data

Jun. 20, 2017 (CN) ..... 2017 1 0471457

(51) Int. Cl.
*G08B 13/12* (2006.01)
*G08B 29/18* (2006.01)

(52) U.S. Cl.
CPC ..... *G08B 13/12* (2013.01); *G08B 29/185* (2013.01)

(58) Field of Classification Search
CPC ..... G08B 13/12; G08B 29/185
USPC ..... 340/568.2
See application file for complete search history.

(56) References Cited

U.S. PATENT DOCUMENTS 7,859,403 B2 * 12/2010 Tampke ..... H04M 11/002 340/506
9,609,003 B1 * 3/2017 Chmielewski ..... G06F 3/041
9,959,721 B1 * 5/2018 Zhang ..... G08B 13/1427
2004/0019720 A1 * 1/2004 Trembley ..... G06F 13/4282 710/110
2006/0290519 A1 * 12/2006 Boate ..... G07C 9/00111 340/573.4
2007/0290835 A1 * 12/2007 Engel Hardt ..... G01R 15/142 340/538.16
2010/0306533 A1 * 12/2010 Phatak ..... G06F 21/34 713/156
2012/0309375 A1 * 12/2012 Austin ..... H04W 4/50 455/418
2014/0098671 A1 * 4/2014 Raleigh ..... H04L 69/14 370/235
2017/0054770 A1 * 2/2017 Wells ..... H04L 65/403
2017/0070563 A1 * 3/2017 Sundermeyer ..... H04L 67/025
2018/0219976 A1 * 8/2018 Decenzo ..... H04L 67/10

* cited by examiner

*Primary Examiner* — Kerri L McNally
*Assistant Examiner* — Thang D Tran
(74) *Attorney, Agent, or Firm* — Kaplan Breyer Schwarz, LLP

(57) ABSTRACT

A networking communication protocol for a multi-slave cable anti-theft monitoring system, the system including a central office, a master and slaves, wherein the central office and the master are connected based on a GPRS, and the master and multiple slaves are connected based on power carrier communication. Communication in the system is mainly initiated by the master, the master realizes site registration and data reporting at the central office through GPRS communication to aggregate global information of the system. Data interaction between the master and the slaves is achieved through the power carrier communication to complete local data collection and a cable on-off test of the slaves. The master is provided with a periodic collection timer to realize periodic data collection of all slaves on a monitored line.

5 Claims, 1 Drawing Sheet

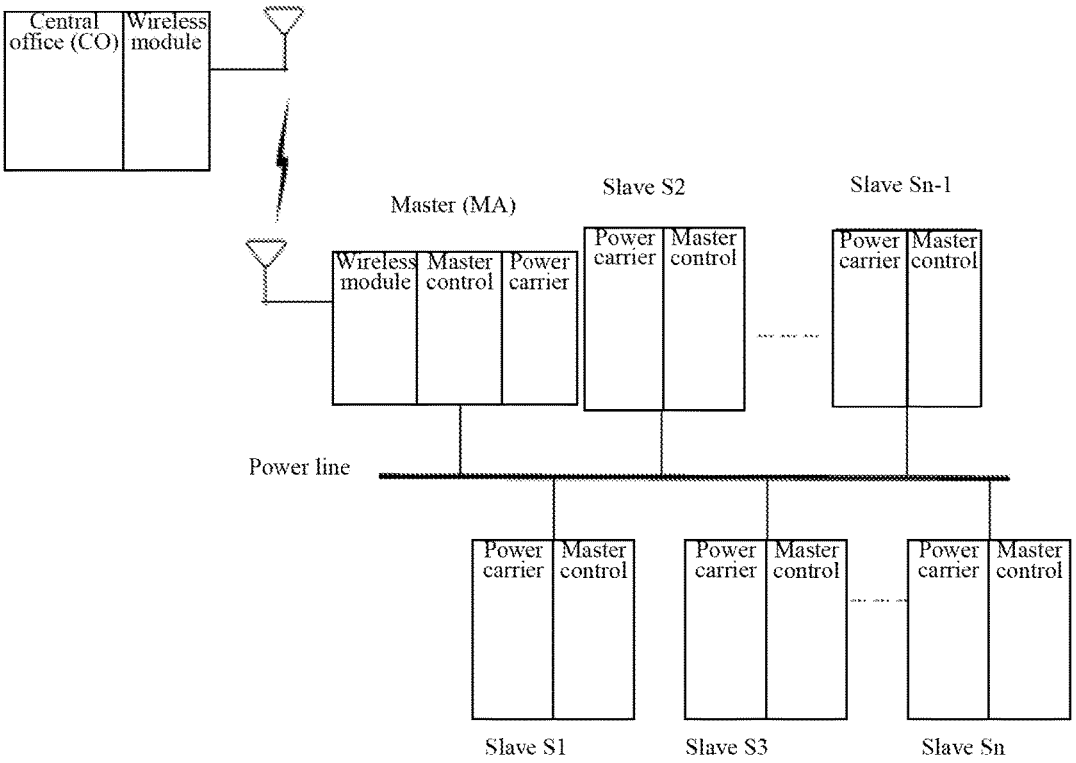
Central office (CO)
Wireless module
Master (MA)
Wireless module
Master control
Power carrier
Slave S2
Power carrier
Master control
Slave Sn-1
Power carrier
Master control
Power line
Power carrier
Master control
Slave S1
Power carrier
Master control
Slave S3
Power carrier
Master control
Slave Sn

NETWORKING COMMUNICATION METHOD FOR MULTI-SLAVE CABLE ANTI-THEFT MONITORING SYSTEM

FIELD OF THE INVENTION

The present invention relates to the field of cable networking and communication, in particular to a networking communication method for a multi-slave cable anti-theft monitoring system.

DESCRIPTION OF THE RELATED ART

With the rapid development of the national economy, short supply of various metal resources induces frequent occurrence of cable thefts. Because power lines transmit low-voltage power and are widely distributed, cable thefts are increasingly rampant, seriously affecting the daily life of people, and also bringing economic losses.

Previous cable laying methods such as direct burial, deep burial, plugging and concrete packing have been gradually replaced by more intelligent high-tech anti-theft means with the advances of technology.

The prior art discloses an intelligent anti-theft monitoring system for highways, and provides an intelligent anti-theft monitoring system using power carrier technology. The system is mainly realized through a three-level architecture, i.e., a monitoring center, a monitoring master and a monitoring slave, solving related problems with long distance and wide distribution of highways and features of toll gates. However, the technology still has the following problems:

(1) a networking problem of carrier communication in the system, that is, the problem of using which routing sites for forwarding a data frame from a master to a target slave, as the distance of carrier communication is very limited; and (2) during carrier communication, the master may be unable to communicate directly with the target slave, as a result, routing sites are required as relay sites to forward the data frame, which may be misjudged.

The two problems will result in low precision of alarm points and high false alarm rate of such cable anti-theft monitoring system.

SUMMARY OF THE INVENTION

With regard to the defects in the prior art, a technical problem to be solved by the invention is to provide a cable anti-theft monitoring system with accurate position of alarm points and low false alarm rate.

In order to achieve the purpose, the invention provides the following solution: a networking communication method for a multi-slave cable anti-theft monitoring system, wherein the cable anti-theft monitoring system using the networking communication protocol is composed of a central office, a master and slaves, and the central office receives a message of a cable status monitoring result, reported by the master, and presents the status of the system to a user through a human-machine interface; the master and the slaves monitor a work status of a cable in real time based on power line carrier communication and data collection, and reports a monitoring result to the central office over a GPRS wireless network; and the slaves receive a cable status data query command from the master and feed a local collection result back to the master;

as a timer is arranged at each site of the system, the central office, the master and the slave Sn perform initialization respectively after the system is powered on, which is characterized in that the execution flow of a networking and communication protocol between communication sites is described as follows:

A1: the master sends a site registration application message to the central office via a wireless communication module, and starts a registration feedback timer thereof;

A2: after receiving the registration application message from the master, the central office first determines whether the master has been registered, if the master has been registered, the central office sends a registration confirmation message to the master directly via the wireless communication module; if the master is not registered, the central office writes information on the master to a list of sites in a database, and then replies a registration confirmation message to the master; after the registration confirmation message is sent to the master, the central office starts a site failure timer for the master to be registered;

A3: after receiving the registration confirmation message, the master turns off the registration feedback timer and verifies the correctness of the message, the registration is successful if the message is correct, the master will change a registration flag REG=1 thereof, then construct a piggybacking slave data request frame, and sends the data request frame via a power carrier communication module to the slave Sn furthest from the master, where the slave Sn is located on a monitored line, n is a positive integer greater than 2, and a slave response timer is turned on;

A4: after receiving the piggybacking data request, the slave Sn first turns off a site failure timer thereof and verifies the correctness of the message, if the message is correct, the slave Sn will collect relevant local data information according to the data request and insert the data information in a piggybacking data request feedback frame, and send the data request feedback frame to the last slave Sn−1 via the power carrier communication module, after sending the data frame, the slave Sn will restart the site failure time to wait for the next data request;

A5: after receiving the piggybacking data request feedback frame with response data from the slave Sn, the slave Sn−1 turns off a site failure timer thereof and verifies the correctness of the message, if the message is correct, the slave Sn−1 will also insert relevant local data information in a piggybacking data request feedback frame, and send the data request feedback frame to the last slave Sn−2 via the power carrier communication module, after sending the data frame, the slave Sn−1 will restart the site failure time;

A6: similar to the slave Sn and the slave Sn−1, after verifying the correctness of the message, a preorder slave inserts local data information in a piggybacking data request feedback frame and sends the data request feedback frame to the last slave until the slave S1 closest to the master receives the message for processing and sends the processed message back to the master via the power carrier communication module;

A7: after receiving the piggybacking data request feedback frame from the slave S1, the master turns off the slave feedback timer and verifies the correctness of the message, if the message is correct, the master constructs a data collection message according to the data request feedback frame and sends the data collection message to the central office; and A8: after receiving the data collection message reported by the master, the central office first turns off the corresponding site failure timer and verifies the correctness of the message, if the message is correct, the central office writes the data information to a database, after writing the data information, the central office will restart the corresponding site failure timer to wait for the next data reporting from the master.

In the communication method, the system can ensure periodic two-way data communication between the central office and the master and between the master and multiple slaves by providing timers with different functions in the sites so as to achieve the purposes of cable anti-theft and status monitoring.

Further, the master is provided with a periodic collection timer, and when the periodic collection timer is interrupted, the master constructs a piggybacking data request frame and sends the data request frame to the slave Sn for a new round of data requests for all sites.

Periodic data collection of all slaves on a monitored line is realized by arranging the periodic collection timer in the master.

Further, the system handles a communication exception between two parts in an effective time due to a cable or slave equipment failure, based on whether the master and the slaves receive any new message before the corresponding timer is interrupted.

Further, if the master fails to receive the registration confirmation message from the central office before the registration feedback timer is interrupted, and the maximum number of registration applications MAX_Reg_Num has not yet reached, then the master constructs another site registration application and sends the site registration application to the central office via the wireless communication module, and starts the registration feedback timer to wait for a response; if the maximum number of registration applications MAX_Reg_Num has reached, the master will start an alarm program.

Further, when a failure occurs to a section of a monitored line of the master, and a communication channel between two slaves is interrupted, the master is unable to get a feedback of the piggybacking data request frame, and will perform collection exception detection in the following steps:

B1: the periodic collection timer of the master and the slave response timer are turned off to enter a collection exception detection mode;

B2: the master constructs a general data request frame and sends the data request frame to the closest slave S1 via the power carrier communication module, starts a collection exception detection timer and records the times to send the data request frame;

B3: after receiving the data request frame from the master, the slave S1 turns off the corresponding site failure timer and verifies the correctness, if the data request frame is correct, the slave S1 collects relevant data and constructs a data request response, and sends the data request response back to the master via the power carrier communication module;

B4: if the master receives the data request response from the slave S1 before the collection exception detection timer is interrupted, the master turns off the collection exception detection timer and verifies the correctness, if the message is correct, the master constructs a data collection message according to the data request response, sends the data collection message to the central office via a wireless module, and resets the number of repeats of the data request; after reporting, the master (MA) constructs another general data request frame and sends the data request frame via the power carrier communication module to a slave $S_{(n+1)/2}$ in the middle on a monitoring cable, and starts the collection exception detection timer to record the number of times to send the data request frame;

B5: the slave $S_{(n+1)/2}$ sends the data request response back to the master by performing the same operation as the slave S1;

B6: if the master (MA) receives the data request response from the slave $S_{(n+1)/2}$ before the collection exception detection timer is interrupted, it indicates that a cable between the slave S and the slave $S_{(n+1)/2}$ is intact and failure-free, and the master will perform failure detection on the cable between the slave $S_{(n+1)/2}$ and the slave Sn; if the master fails to receive the data request response from the slave before the collection exception detection timer is interrupted, it indicates that a failure occurs to the cable between the slave S1 and the slave $S_{(n+1)/2}$, the master selects an intermediate site $S_{(n+1)/4}$ between the slave $S_{(n+1)/2}$ and the slave to send a data request and further determines a faulted cable segment;

B7: the master performs collection exception detection on slaves on the cable successively based on the principle of dichotomy, that is, sends a general data request and waits for a response, if the response to the data request is normal, the master reports a data collection message to the central office; if a detected slave fails to respond to data when the maximum number of collection exception detection MAX_Abn_Num is reached, the master constructs a loss alarm message of the slave after turning off the collection exception detection timer and sends the loss alarm message to the central office, and starts a local alarm program; and B8: after giving an alarm of the faulted slave, the master resets the number of repeats of the data request, constructs a general data request frame and sends the data request frame to a subsequent slave to continue the collection exception detection.

The beneficial effects of the present invention are as follows: the invention solves the problem that normal communication between two parts may be impossible in an effective time due to a cable or slave equipment failure during implementation of a communication method.

DESCRIPTION OF THE DRAWING

FIG. 1 shows main network nodes of the related communication protocol system.

DESCRIPTION OF THE PREFERRED EMBODIMENT

The utility model will be further described in combination with accompanying drawings and embodiments.

The present invention will be further described in detail in combination with accompanied drawings and embodiments for clear understanding of the purpose, features and advantages of the invention.

An applicable cable anti-theft monitoring system of the design method is composed of a central office, a master and slaves. The central office receives a message of a cable status monitoring result, reported by the master, and presents the status of the system to a user through a human-machine interface; the master and the slaves monitor a work status of a cable in real time based on power line carrier communication and data collection, and reports a monitoring result to the central office over a GPRS wireless network; and the slaves receive a cable status data query command from the master and feed a local collection result back to the master. FIG. 1 shows main network nodes of the system.

Execution steps of a networking and communication protocol of the system are further described based on FIG. 1. The central office (CO), the master (MA) and the slaves perform initialization on corresponding communication modules after the system is powered on. After the initialization, the execution flow of a networking and communication protocol between communication sites is described as follows:

A1: the master (MA) sends a site registration application message to the central office (CO) via a wireless communication module, and starts a registration feedback timer (TM0) thereof to wait for a response from the central office (CO);

A2: after receiving the registration application message from the master (MA), the central office (CO) first determines whether the master has been registered, if the master has been registered, the central office sends a registration confirmation message to the master directly via the wireless communication module; if the master is not registered, the central office writes information on the master to a list of sites in a database, and then replies a registration confirmation message to the master; after the registration confirmation message is sent to the master, the central office (CO) starts a site failure timer (TC0) for the master to be registered;

A3: after receiving the registration confirmation message, the master (MA) turns off the registration feedback timer (TM0) and verifies the correctness of the message, the registration is successful if the message is correct, the master will change a registration flag REG=1 thereof, then construct a piggybacking slave data request frame, and sends the data request frame via a power carrier communication module to the slave Sn furthest from the master, where the slave Sn is located on a monitored line, and a slave response timer (TM2) is turned on;

A4: after receiving the piggybacking data request, the slave Sn first turns off a site failure timer (TS0) thereof and verifies the correctness of the message, if the message is correct, the slave Sn will collect relevant local data information according to the data request and insert the data information in a piggybacking data request feedback frame, and send the data request feedback frame to the last slave Sn−1 via the power carrier communication module, after sending the data frame, the slave Sn will restart the site failure time (TS0) to wait for the next data request;

A5: after receiving the piggybacking data request feedback frame with response data from the slave Sn, the slave Sn−1 turns off a site failure timer (TS0) thereof and verifies the correctness of the message, if the message is correct, the slave Sn−1 will also insert relevant local data information in a piggybacking data request feedback frame, and send the data request feedback frame to the last slave Sn−2 via the power carrier communication module, after sending the data frame, the slave Sn−1 will restart the site failure time (TS0) to wait for the next data request;

A6: similar to the slave Sn and the slave Sn−1, after verifying the correctness of the message, a preorder slave inserts local data information in a piggybacking data request feedback frame and sends the data request feedback frame to the last slave until the slave S1 closest to the master (MA) receives the message for processing and sends the processed message back to the master (MA) via the power carrier communication module;

A7: after receiving the piggybacking data request feedback frame from the slave S1, the master (MA) turns off the slave feedback timer (TM1) and verifies the correctness of the message, if the message is correct, the master constructs a data collection message according to the data request feedback frame and sends the data collection message to the central office (CO); and A8: after receiving the data collection message reported by the master (MA), the central office (CO) first turns off the corresponding site failure timer (TC0) and verifies the correctness of the message, if the message is correct, the central office writes the data information to a database, after writing the data information, the central office (CO) will restart the corresponding site failure timer (TC0) to wait for the next data reporting from the master (MA).

The normal work process also includes: the master (MA) is provided with a periodic collection timer (TM1), and when the timer is interrupted, the master (MA) constructs a piggybacking data request frame and sends the data request frame to the slave Sn for a new round of data requests for all sites to realize periodic data collection of all slaves on a monitored line.

In addition to the normal communication, normal communication between two parts of the system may be impossible in an effective time due to a cable or slave equipment failure. Possible failures during communication and corresponding countermeasures will be further described in detail.

If the master (MA) fails to receive the registration confirmation message from the central office (CO) before the registration feedback timer is interrupted, and the maximum number of registration applications MAX_Reg_Num has not yet reached, then the master constructs another site registration application and sends the site registration application to the central office via the wireless communication module, and starts the registration feedback timer to wait for a response. If the maximum number of registration applications MAX_Reg_Num has reached, the master will start an alarm program.

When a failure occurs to a section of a monitored line of the master (MA), and a communication channel between two slaves is interrupted, the master (MA) is unable to get a feedback of the piggybacking data request frame, and will perform collection exception detection in the following steps:

B1: the periodic collection timer (TM1) of the master (MA) and the slave response timer (TM2) are turned off to enter a collection exception detection mode;

B2: the master (MA) constructs a general data request frame and sends the data request frame to the closest slave S via the power carrier communication module, starts a collection exception detection timer (TM3) and records the times to send the data request frame;

B3: after receiving the data request frame from the master (MA), the slave S1 turns off the corresponding site failure timer (TS0) and verifies the correctness, if the data request frame is correct, the slave S1 collects relevant data and constructs a data request response, and sends the data request response back to the master (MA) via the power carrier communication module;

B4: if the master (MA) receives the data request response from the slave S1 before the collection exception detection timer (TM3) is interrupted, the master (MA) turns off the collection exception detection timer (TM3) and verifies the correctness, if the message is correct, the master (MA) constructs a data collection message according to the data request response, sends the data collection message to the central office (CO) via a wireless module, and resets the number of repeats of the data request; after reporting, the master (MA) constructs another general data request frame and sends the data request frame via the power carrier communication module to a slave $S_{(n+1)/2}$ in the middle on a monitored cable, and starts the collection exception detection timer (TM3) to record the number of times to send the data request frame;

B5: the slave $S_{(n+1)/2}$ sends the data request response back to the master by performing the same operation as the slave S1;

B6: if the master (MA) receives the data request response from the slave $S_{(n+1)/2}$ before the collection exception detection timer (TM3) is interrupted, it indicates that a cable between the slave S1 and the slave $S_{(n+1)/2}$ is intact and failure-free, and the master (MA) will perform failure detection on the cable between the slave $S_{(n+1)/2}$ and the slave Sn; if the master (MA) fails to receive the data request response from the slave $S_{(n+1)/2}$ before the collection exception detection timer (TM3) is interrupted, it indicates that a failure occurs to the cable between the slave S1 and the slave $S_{(n+1)/2}$, the master (MA) selects an intermediate site $S_{(n+1)/4}$ between the slave S1 and the slave $S_{(n+1)/2}$ to send a data request and further determines a faulted cable segment;

B7: the master (MA) performs collection exception detection on slaves on the cable successively based on the principle of dichotomy, that is, sends a general data request and waits for a response, if the response to the data request is normal, the master reports a data collection message to the central office (CO); if a detected slave fails to respond to data when the maximum number of collection exception detection MAX_Abn_Num is reached, the master (MA) constructs a loss alarm message of the slave after turning off the collection exception detection timer (TM3) and sends the loss alarm message to the central office (CO), and starts a local alarm program; and B8: after giving an alarm of the faulted slave, the master (MA) resets the number of repeats of the data request, constructs a general data request frame and sends the data request frame to a subsequent slave to continue the collection exception detection.

A data frame format is designed for information interaction between the central station (CO) and the master (MA) over the wireless network: in the system, wireless communication between the master (MA) and the central station (CO) is realized by an SMS. According to the limit of maximum message length of the SMS, the maximum length of the wireless communication frame to be designed does not exceed 160 bytes. The specific format of an interactive message frame is as follows:

| Frame header | Site address 4 bytes | | Data type | Data length | Data section | Frame end |
|---|---|---|---|---|---|---|
| 2 bytes | Source address 2 bytes | Destination address 2 bytes | 1 byte | 1 byte | Variable | 1 byte |

A data frame format is designed for information interaction between the master (MA) and the slaves via the power carrier communication module. The specific format of an interactive message frame is as follows:

| Presynchronization head 2 bytes | Frame synchronization head 6 bytes | End-to-end site address 4 bytes | | Data type 1 byte | Data length 1 byte | Source address 2 bytes | Destination address 2 bytes | Data field Length variable | Frame end 1 byte |
|---|---|---|---|---|---|---|---|---|---|
| | | Source address 2 bytes | Destination address 2 bytes | | | | | | |

In order to verify the performance of the method provided in the present invention, simulations are performed on data collection time by the method provided in the present invention and a reference site-by-site polling method, and comparison is made. In the site-by-site polling method, the master initiates communication in the system, sends a data request to a slave at a time, and sends a data request to the next slave after getting a response from the slave. In a site-by-site polling mode, the method is also used for failure detection to successively detect slaves in the system until a faulted slave is detected. Simulation settings are as follows: data collection simulations are performed on systems with different number of slaves, N=[10, 15, 20], the communication time between the master and the first slave is 0.7 s, the communication time between the slaves is within (0.1 s), and three different failure rates are set for the system, when the failure probability randomly generated by the system is greater than the set failure rate, a failure or broken cable occurs in the system.

In the simulation of data collection time (including data collection in the absence of failure and failure detection in the presence of failure) of the system by the method provided in the present invention and the reference site-by-site polling method, it can be seen from the average result of 1000 Monte Carlo simulations that the average data collection time by the method provided in the present invention is much smaller than that by the site-to-site polling method in the event of the same failure rate for systems with the same number of slaves, and the method provided in the present invention has obviously improved performance.

Preferred embodiments of the present invention are described in detail above. It should be understood that those of ordinary skill in the art may make various modifications and changes in accordance with the concept of the utility model without creative work. Therefore, all technical solutions that can be obtained by those skilled in the art through logical analysis, reasoning, or limited experiments on the basis of the concept of the utility model shall be incorporated in the protection scope defined by the claims.

The invention claimed is:

1. A networking communication method for a multi-slave cable anti-theft monitoring system, wherein the cable anti-theft monitoring system using the networking communication protocol is composed of a central office, a master and slaves, and the central office receives a message of a cable status monitoring result, reported by the master, and presents the status of the system to a user through a human-machine interface; the master and the slaves monitor a work status of a cable in real time based on power line carrier communication and data collection, and reports a monitoring result to the central office over a GPRS wireless network; and the slaves receive a cable status data query command from the master and feed a local collection result back to the master;

as a timer is arranged at each site of the system, the central office (CO), the master (MA) and the slave Sn perform initialization respectively after the system is powered on, which is characterized in that the execution flow of a networking and communication protocol between communication sites is described as follows:

A1: the master (MA) sends a site registration application message to the central office via a wireless communication module, and starts a registration feedback timer thereof;

A2: after receiving the registration application message from the master (MA), the central office (CO) first determines whether the master has been registered, if the master has been registered, the central office sends a registration confirmation message to the master directly via the wireless communication module; if the master is not registered, the central office writes information on the master to a list of sites in a database, and then replies a registration confirmation message to the master; after the registration confirmation message is sent to the master, the central office starts a site failure timer for the master to be registered;

A3: after receiving the registration confirmation message, the master (MA) turns off the registration feedback timer and verifies the correctness of the message, the registration is successful if the message is correct, the master will change a registration flag REG=1 thereof, then construct a piggybacking slave data request frame, and sends the data request frame via a power carrier communication module to the slave Sn furthest from the master, where the slave Sn is located on a monitored line, n is a positive integer greater than 2, and a slave response timer is turned on;

A4: after receiving the piggybacking data request, the slave Sn first turns off a site failure timer thereof and verifies the correctness of the message, if the message is correct, the slave Sn will collect relevant local data information according to the data request and insert the data information in a piggybacking data request feedback frame, and send the data request feedback frame to the last slave Sn−1 via the power carrier communication module, after sending the data frame, the slave Sn will restart the site failure time to wait for the next data request;

A5: after receiving the piggybacking data request feedback frame with response data from the slave Sn, the slave Sn−1 turns off a site failure timer thereof and verifies the correctness of the message, if the message is correct, the slave Sn−1 will also insert relevant local data information in a piggybacking data request feedback frame, and send the data request feedback frame to the last slave Sn−2 via the power carrier communication module, after sending the data frame, the slave Sn−1 will restart the site failure time;

A6: similar to the slave Sn and the slave Sn−1, after verifying the correctness of the message, a preorder slave inserts local data information in a piggybacking data request feedback frame and sends the data request feedback frame to the last slave until the slave S1 closest to the master (MA) receives the message for processing and sends the processed message back to the master (MA) via the power carrier communication module;

A7: after receiving the piggybacking data request feedback frame from the slave S1, the master (MA) turns off the slave feedback timer and verifies the correctness of the message, if the message is correct, the master constructs a data collection message according to the data request feedback frame and sends the data collection message to the central office (CO); and A8: after receiving the data collection message reported by the master (MA), the central office (CO) first turns off the corresponding site failure timer and verifies the correctness of the message, if the message is correct, the central office writes the data information to a database, after writing the data information, the central office (CO) will restart the corresponding site failure timer to wait for the next data reporting from the master (MA).

2. A networking communication method for a multi-slave cable anti-theft monitoring system according to claim 1, characterized in that the master (MA) is provided with a periodic collection timer, and when the periodic collection timer is interrupted, the master (MA) constructs a piggybacking data request frame and sends the data request frame to the slave Sn for a new round of data requests for all sites.

3. A networking communication method for a multi-slave cable anti-theft monitoring system according to claim 2, characterized in that the system handles a communication exception between two parts in an effective time due to a cable or slave equipment failure, based on whether the master and the slaves receive any new message before the corresponding timer is interrupted.

4. A networking communication method for a multi-slave cable anti-theft monitoring system according to claim 3, characterized in that if the master (MA) fails to receive the registration confirmation message from the central office (CO) before the registration feedback timer is interrupted, and the maximum number of registration applications MAX_Reg_Num has not yet reached, then the master constructs another site registration application and sends the site registration application to the central office via the wireless communication module, and starts the registration feedback timer to wait for a response; if the maximum number of registration applications MAX_Reg_Num has reached, the master will start an alarm program.

5. A networking communication method for a multi-slave cable anti-theft monitoring system according to claim 3, characterized in that when a failure occurs to a section of a monitored line of the master (MA), and a communication channel between two slaves is interrupted, the master (MA) is unable to get a feedback of the piggybacking data request frame, and will perform collection exception detection in the following steps:

B1: the periodic collection timer of the master (MA) and the slave response timer are turned off to enter a collection exception detection mode;

B2: the master (MA) constructs a general data request frame and sends the data request frame to the closest slave S1 via the power carrier communication module, starts a collection exception detection timer and records the times to send the data request frame;

B3: after receiving the data request frame from the master (MA), the slave S1 turns off the corresponding site failure timer and verifies the correctness, if the data request frame is correct, the slave S1 collects relevant data and constructs a data request response, and sends the data request response back to the master (MA) via the power carrier communication module;

B4: if the master (MA) receives the data request response from the slave S1 before the collection exception detection timer is interrupted, the master (MA) turns off the collection exception detection timer and verifies the correctness, if the message is correct, the master (MA) constructs a data collection message according to the data request response, sends the data collection message to the central office (CO) via a wireless module, and resets the number of repeats of the data request; after reporting, the master (MA) constructs another general data request frame and sends the data request frame via the power carrier communication module to a slave $S_{(n+1)/2}$ in the middle on a monitoring cable, and starts the collection exception detection timer to record the number of times to send the data request frame;

B5: the slave $S_{(n+1)/2}$ sends the data request response back to the master by performing the same operation as the slave S1;

B6: if the master (MA) receives the data request response from the slave $S_{(n+1)/2}$ before the collection exception detection timer is interrupted, it indicates that a cable between the slave S1 and the slave $S_{(n+1)/2}$ is intact and failure-free, and the master (MA) will perform failure detection on the cable between the slave $S_{(n+1)/2}$ and the slave Sn; if the master (MA) fails to receive the data request response from the slave $S_{(n+1)/2}$ before the collection exception detection timer is interrupted, it indicates that a failure occurs to the cable between the slave S1 and the slave $S_{(n+1)/2}$, the master (MA) selects an intermediate site $S_{(n+1)/4}$ between the slave S1 and the slave $S_{(n+1)/2}$ to send a data request and further determines a faulted cable segment;

B7: the master (MA) performs collection exception detection on slaves on the cable successively based on the principle of dichotomy, that is, sends a general data request and waits for a response, if the response to the data request is normal, the master reports a data collection message to the central office (CO); if a detected slave fails to respond to data when the maximum number of collection exception detection MAX_Abn_Num is reached, the master (MA) constructs a loss alarm message of the slave after turning off the collection exception detection timer and sends the loss alarm message to the central office (CO), and starts a local alarm program; and B8: after giving an alarm of the faulted slave, the master (MA) resets the number of repeats of the data request, constructs a general data request frame and sends the data request frame to a subsequent slave to continue the collection exception detection.

* * * * *